US006283043B1

(12) United States Patent
Stern et al.

(10) Patent No.: US 6,283,043 B1
(45) Date of Patent: Sep. 4, 2001

(54) TRADER DESK

(75) Inventors: Timothy R. Stern, Grand Rapids, MI (US); Gerd Althofer, New York, NY (US); Peter D. Howard, Greenwood, MS (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/495,321

(22) Filed: Jan. 31, 2000

(51) Int. Cl.[7] ..... A47B 37/00
(52) U.S. Cl. ..... 108/50.02; 312/223.6
(58) Field of Search ..... 108/50.01, 50.02, 108/23, 144.11, 147.21, 108; 312/223.6, 196; 52/239

(56) References Cited

U.S. PATENT DOCUMENTS

| | | | | |
|---|---|---|---|---|
| 3,066,774 | | 12/1962 | Dahme . | |
| 3,305,286 | | 2/1967 | Fenwick . | |
| 3,517,623 | | 6/1970 | Goldstein et al. . | |
| 3,834,325 | | 9/1974 | DeWilde . | |
| 4,022,136 | | 5/1977 | Schott . | |
| 4,378,727 | | 4/1983 | Doss . | |
| 4,604,955 | | 8/1986 | Fleischer et al. . | |
| 4,619,486 | | 10/1986 | Hannah et al. . | |
| 4,646,655 | | 3/1987 | Robolin . | |
| 4,838,177 | | 6/1989 | Vander Park . | |
| 4,883,330 | | 11/1989 | Armstrong et al. . | |
| 4,941,412 | | 7/1990 | Engel . | |
| 5,024,167 | | 6/1991 | Hayward . | |
| 5,237,935 | * | 8/1993 | Newhouse et al. | 108/50.02 |
| 5,394,809 | * | 3/1995 | Feldpausch et al. | 108/147.21 |
| 5,522,323 | * | 6/1996 | Richard | 108/50.01 X |
| 5,522,324 | | 6/1996 | van Gelder et al. . | |
| 5,531,168 | | 7/1996 | Towfigh . | |
| 5,544,593 | | 8/1996 | Canfield et al. . | |
| 5,588,376 | | 12/1996 | Seidl et al. . | |
| 5,606,920 | * | 3/1997 | Meyer et al. | 108/50.02 |
| 5,704,299 | * | 1/1998 | Corpuz, Jr. et al. | 108/50.01 |
| 5,752,449 | * | 5/1998 | Simon et al. | 108/50.02 |
| 5,881,500 | | 3/1999 | Latino et al. . | |
| 5,947,569 | * | 9/1999 | Rheault et al. | 108/50.02 X |
| 5,975,657 | | 11/1999 | LaCour . | |
| 6,029,587 | * | 2/2000 | Rozier, Jr. et al. | 108/147.21 |
| 6,152,048 | * | 11/2000 | Vander Park | 108/50.02 |

* cited by examiner

*Primary Examiner*—Jose V. Chen
(74) *Attorney, Agent, or Firm*—Price, Heneveld, Cooper, DeWitt & Litton

(57) ABSTRACT

A knock-down trader desk including a frame having at least two upright frame members and at least two horizontal beams. The beams releasably interconnect the upright frame members to form a freestanding knock-down rigid frame. A plurality of vertically oriented panels are attached to the rigid frame to define a storage area within the rigid frame. The trader desk includes at least three worksurfaces including a pair of outer worksurfaces defining two opposed user accessible elongate edges. The trader desk also includes at least one central worksurface positioned above the storage area and between the outer worksurfaces. The worksurfaces are engagable with the frame at a plurality of heights whereby the worksurfaces are selectively positionable at a plurality of heights. At least one access opening is provided for passing cables from the storage area to an upper surface of the central worksurface.

27 Claims, 6 Drawing Sheets

TRADER DESK

BACKGROUND OF THE INVENTION

The present invention relates to a furniture unit for use in trading rooms and the like, and in particular to a freestanding knock-down furniture arrangement that can be quickly and easily assembled on-site, rearranged and/or adjusted as required for a particular application.

Modern offices are becoming increasingly complicated and sophisticated due largely to the ever increasing needs of the users for improved utilities support at each workstation, such as communications, computers and other types of data processes, electronic displays, etc. For example, trading areas may have a plurality of trader desks arranged in a row, with various computer monitors, communications equipment, and the like supported on the trader desk. Existing trader desk arrangements may include a vertical screen or other structure positioned at the center of the trader desk. For example, U.S. Pat. No. 5,975,657 discloses to a desk system having a centrally positioned vertical slat wall that provides support for various platforms that, in turn, support computer monitors and the like.

SUMMARY OF THE INVENTION

One aspect of the present invention is to provide a knock-down trader desk including a frame having at least two upright frame members and at least two horizontal beams. The beams releasably interconnect the upright frame members to form a freestanding knock-down rigid frame. A plurality of vertically oriented panels are detachably connected to the rigid frame to define a storage area within the rigid frame. The trader desk includes at least three worksurfaces including a pair of outer worksurfaces defining two opposed user accessible elongate edges. The trader desk also includes at least one central worksurface positioned above the storage area and between the outer worksurfaces. The three worksurfaces are engagable with the frame at a plurality of heights, such that the worksurfaces are selectively positionable at a plurality of heights. At least one access opening is provided for passing utility lines from the storage area to an upper surface of the central worksurface.

Another aspect of the present invention is a furniture unit having a knock-down construction including a frame with at least two upright members and at least two horizontally spaced-apart horizontal members. The horizontal members rigidly yet releasably interconnect the upright members to form a rigid frame. At least one generally horizontal worksurface is attached to the frame, and has at least one user accessible elongate edge. The furniture unit also includes a cable support member having opposed C-shaped ends forming hangers. Each of the hangers engage a selected horizontal frame member whereby the cable support member is suspended adjacent the worksurface.

Yet another aspect of the present invention is a trader desk including a frame having spaced-apart vertically extending frame portions defining a central space. A central worksurface extends horizontally into the central space, and the central worksurface is adjustably cantilevered to a selected one of the vertically extending frame portions in a manner permitting attachment of the center support member at a selected one of a plurality of heights within the upwardly-opening central space of the frame for supporting a display screen on the center support member at a selected height. A pair of horizontally spaced-apart outer worksurfaces are attached to the frame and positioned adjacent the central space with the central support between and below the outer worksurfaces.

Yet another aspect of the present invention is a freestanding furniture unit including a rigid frame having at least one vertically extending frame member. The frame member has an upper portion, and the frame has a lower portion adapted to abuttingly support the frame freestanding on a floor surface. First and second horizontal worksurfaces define concave curved edge portions adjacent the upper portion of the frame member, and the concave curved edge portions are horizontally spaced-apart from the upper portion of the vertically extending frame member to define a gap therebetween for routing of utility lines.

These and other advantages of the invention will be further understood and appreciated by those skilled in the art by reference to the following written specification, claims, and appended drawings.

DETAILED DESCRIPTION OF PREFERRED EMBODIMENT

Figure 1:
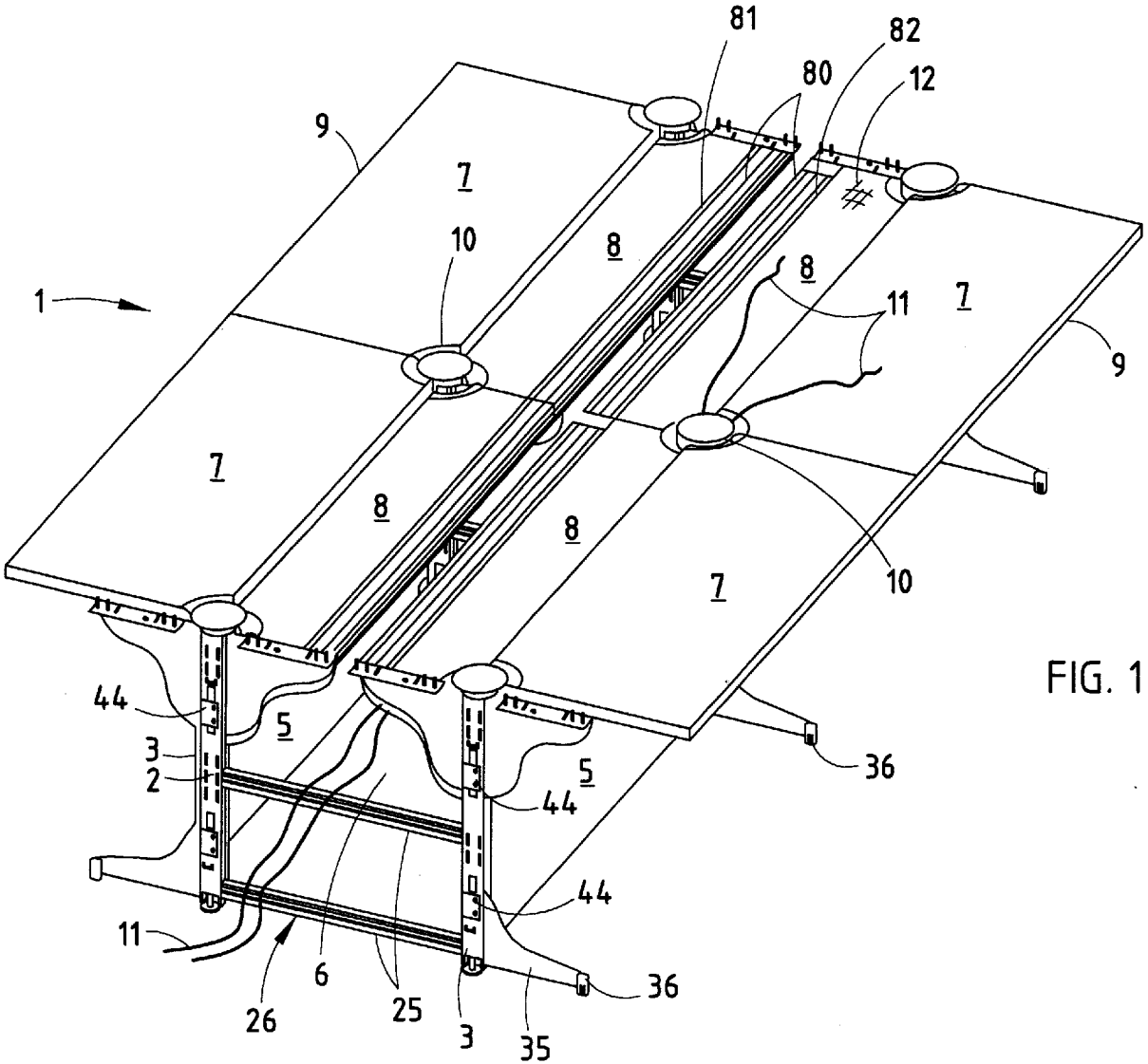
FIG. 1 is a partially fragmentary, perspective view of the trader desk of the present invention, comprising a knock-down frame and adjustable worksurfaces.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a knock-down trader desk embodying the present invention, which is particularly designed for use in offices having trading rooms, and other similar settings and environments. In the illustrated example, the knock-down trader desk 1 includes a frame 2 having at least two upright frame members such as posts 3 (FIG. 3), and at least two horizontal members such as beams 4. The beams 4 releasably interconnect the posts 3 to form a freestanding knock-down rigid frame 2. A plurality of vertically oriented panels 5 are attached to the rigid frame 2 to define a storage area 6 within the rigid frame 2. The trader desk 1 includes at least three worksurfaces including a pair of outer worksurfaces 7 defining two user accessible elongate edges 9 positioned outwardly from the frame 2. At least one central worksurface 8 is positioned above the storage area 6 and between the outer worksurfaces 7. The central worksurface 8 is engagable with the frame 2 at a plurality of heights whereby the central worksurface 8 is selectively positionable at a plurality of heights. Outer worksurfaces 7 are also engagable with frame 2 at a plurality of heights to provide height adjustment. As described in more detail below, the trader desk 1 has at least one access opening 10 for passing utility lines such as electrical cables 11 and the like through storage area 6 to an upper surface 12 of the central worksurface 8.

Figure 2:
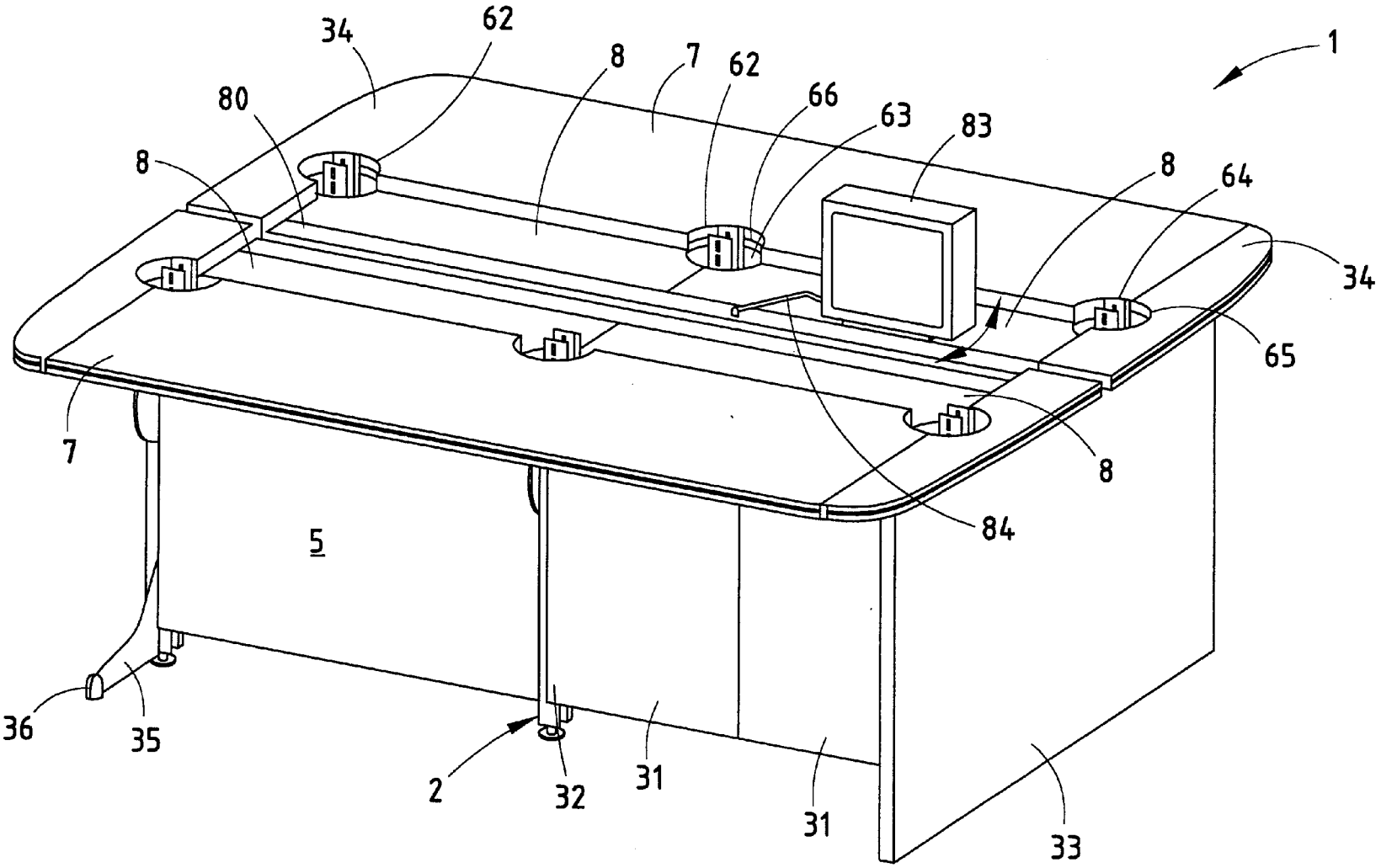
FIG. 2 is a perspective view of the trader desk of FIG. 1 showing end panel and worksurface features.
Figure 3:
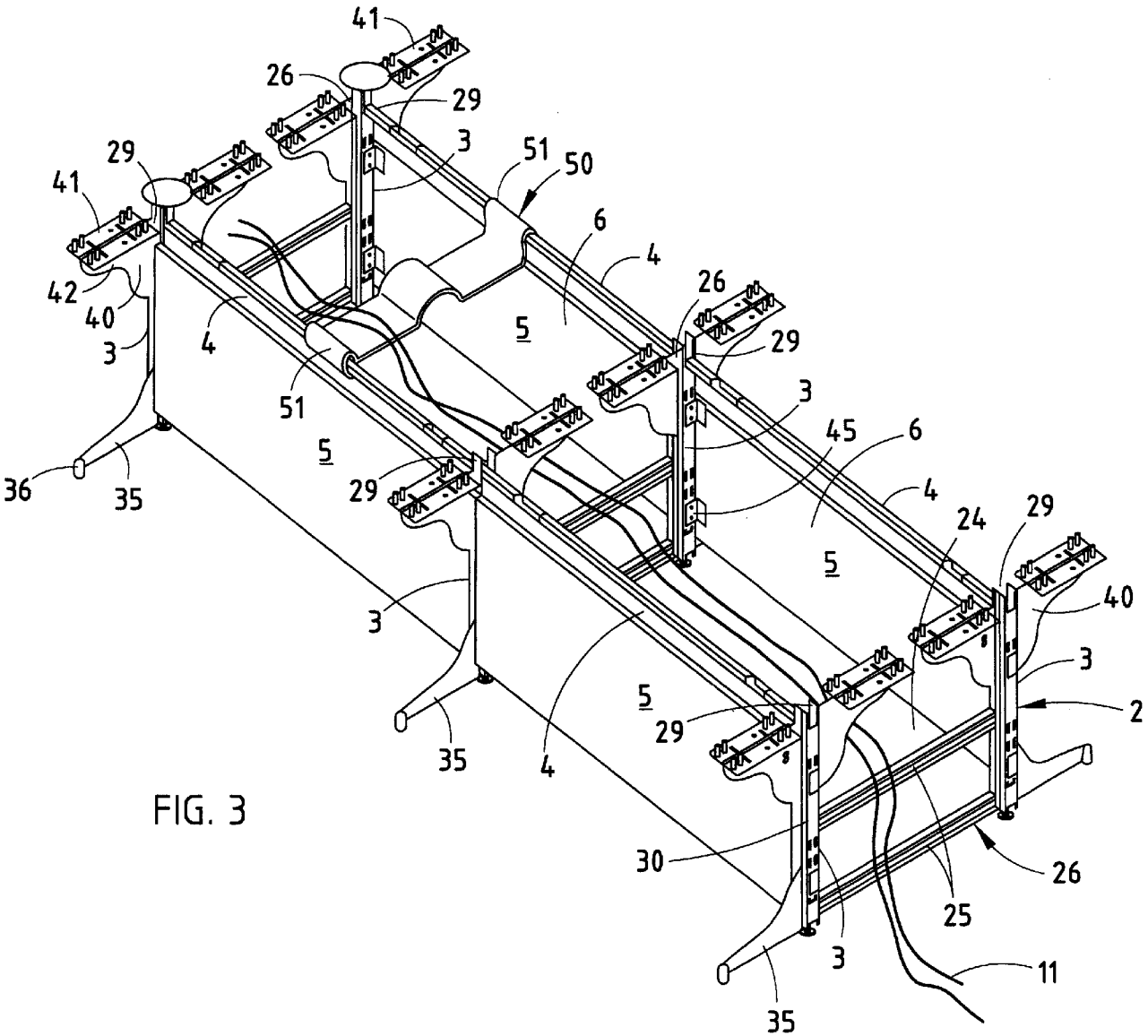
FIG. 3 is a partially fragmentary, perspective view of the trader desk of FIG. 1 with the worksurfaces removed to show the frame construction, storage area, and cable support member.
Figure 4:
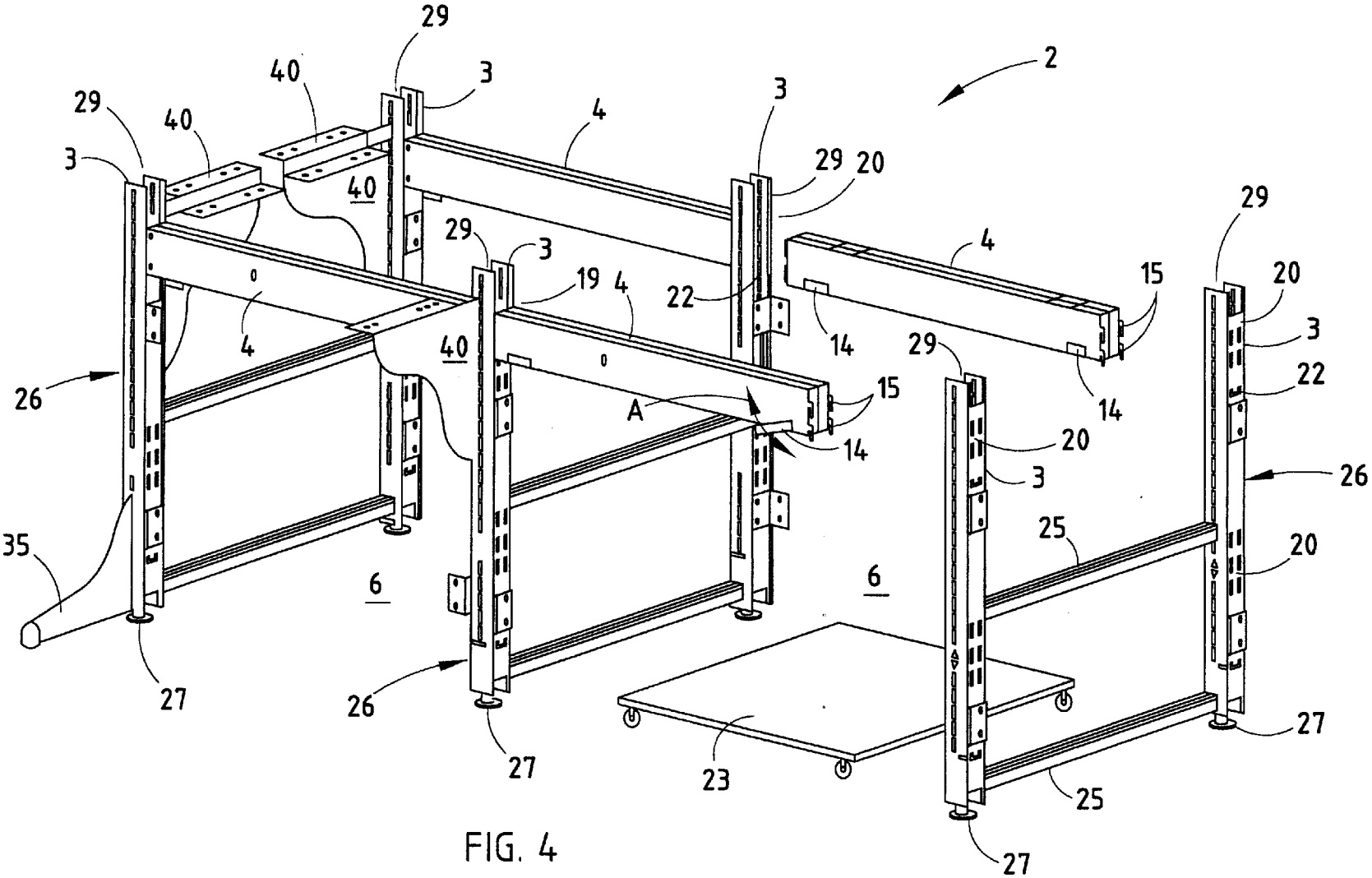
FIG. 4 is a partially fragmentary, exploded perspective view of the frame of FIG. 3.

With reference to FIGS. 3 and 4, the frame 2 of the trader desk 1 of the present invention includes a plurality of posts 3 which are interconnected by one or more horizontal cross members 25 to form an H-frame 26. Cross members 25 are welded or otherwise secured to post 3. A pair of spaced-apart H-frames 26 are interconnected by a pair of beams 4 that are rigidly interconnected with the posts 3 adjacent the upper ends 29 of the posts 3. Posts 3 and beams 4 are rigidly interconnected by a threadless quick-disconnect connector arrangement 19. The connector 19 includes a plurality of hooks 15 on the opposite ends of the beam 4, as well as a moveable lock member or wedge 14. Posts 3 each includes a plurality of beam connection ports 20 having a plurality of slots that receive the hooks 15. During assembly, hooks 15 are inserted into the openings of beam connection port 20, and the beam is shifted downward slightly to engage hooks 15. The moveable lock members 14 are then rotated to the closed position wherein an end portion of the lock member 14 engages an opening 22 in post 3. Lock members 14 are rotatably mounted to the beam 4, and rotate about a vertical axis in the direction of the arrow "A" (FIG. 4). When the end portion of lock member 14 is received within opening 22, hooks 15 are locked in place, and cannot disengage the openings of the beams connection port 20. The present application is related to commonly assigned U.S. Pat. No. 5,899,035, entitled KNOCK-DOWN PORTABLE PARTITION SYSTEM, issued May 4, 1999; commonly assigned U.S. Pat. No. 6,009,675, issued Jan. 4, 2000; commonly assigned U.S. Pat. No. 6,079,173, issued Jun. 27, 2000; commonly assigned co-pending U.S. patent application Ser. No. 09/407,520, filed Sep. 28, 1999, entitled KNOCK-DOWN PORTABLE PARTITION SYSTEM; and commonly assigned U.S. Pat. No. 6,098,358, issued Aug. 8, 2000, all of which are hereby incorporated by reference. The threadless quick connector 19 of the trader desk frame 2 is substantially the same as the quick connector arrangement described in detail in above-identified U.S. Pat. No. 6,098,358. The quick connector arrangement 19 is described in detail in this patent, and hence, will not be further described herein. Each post 3 includes a threaded glide 27 to provide height adjustment to compensate for uneven floor surfaces. Posts 3 include beam connection ports 20 on each of the opposite side faces 30, such additional beams 4 and H-frames 26 may be assembled to the frame 2 as needed to extend the length of the trader desk 1 to whatever length is required for a particular application. Because the beams 4 are attached to the upper ends 29 of the posts 3, electronic equipment and the like can be rolled or otherwise positioned in the storage area 6 on one or more wheeled carts 23 or the like upon removal of cover panels 5. A pair of doors 31 (FIG. 2) may also be utilized in place of a panel 5, thereby providing access to the storage area 6 without requiring removal of a cover panel 5. Doors 31 are pivotally interconnected with posts 3 along the edge 32 by conventional hinges (not shown). An end cover 33 having an extended width may be utilized to close off the trader desk 1 at end-of-run locations. Small, curved end tops 34 (FIG. 3) may be used at end-of-run locations. A plurality of support feet 35 may be connected to the posts 3 for additional stability to prevent tipping of the trader desk 1. Each support foot 1 may include an adjustable glide 36 to accommodate variations in the floor surface.

A plurality of cantilever brackets 40 are connected to the posts 3 and support the worksurfaces 7, 8, and 34. The cantilever brackets 40 include a plurality of hooks (not shown) that engage the vertical row of openings 21 in the posts 3. The cantilever brackets 40 are made of a suitable material, such as sheet metal, and have a thickness that is sufficiently small to permit a pair of side-by-side cantilever brackets 40 to engage a single vertical row of openings 21 in a post 3. This arrangement permits a pair of side-by-side worksurfaces, such as the central worksurfaces 8, to be supported at different heights. Each cantilever bracket 40 includes an upper flange 41 which extends horizontally to one side of the cantilever body 42.

Figure 5:
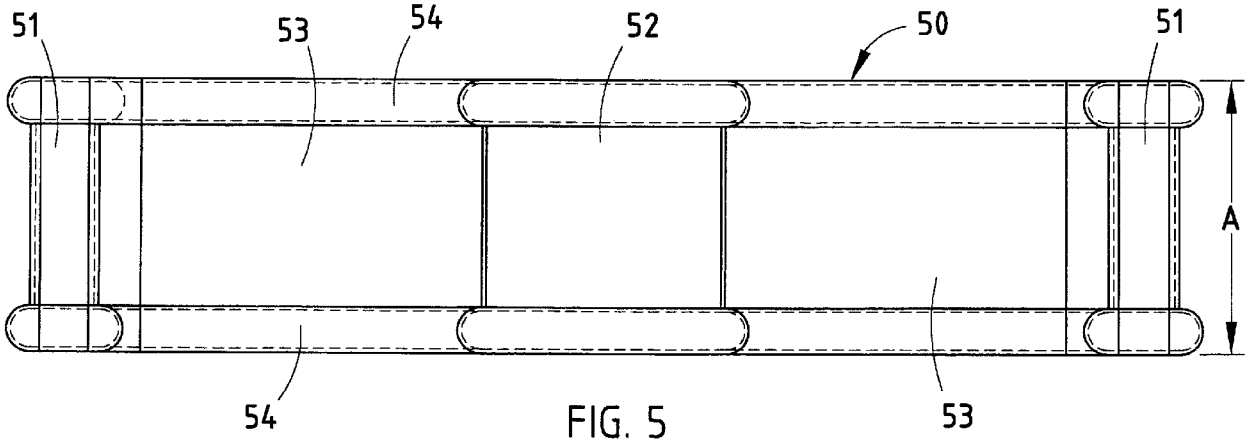
FIG. 5 is a top plan view of the cable support member of FIG. 3.
Figure 6:
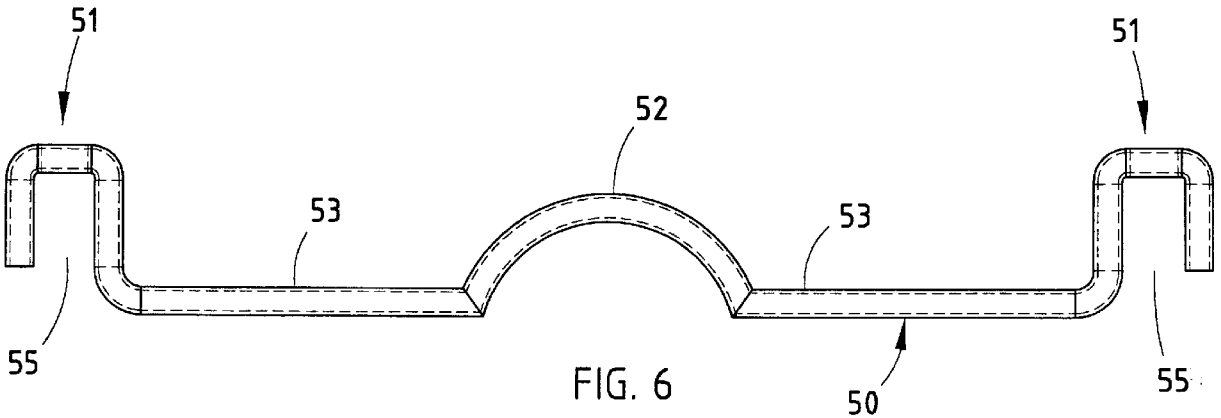
FIG. 6 is a front elevational view of the cable support member of FIG. 5.

Unlike the posts 16 described above, posts 3 include cover panel connectors 44. Connectors 44 are formed from sheet metal, and have a shallow U-shaped cross section wherein the base of the U-shape is spaced-apart from the face of the posts slightly to permit insertion of a flat tab or the like for support of cover panels 5. As illustrated in FIG. 3, brackets 45 interconnect with the connectors 44 for support of the panels 5. Alternately, hinged brackets (not shown) may be used to support the pivoting doors 31 (FIG. 2). A cable support member 50 (FIG. 3) includes C-shaped ends 51 that form hangers for supporting the cable support member 50 on a pair of beams 4. With further reference to FIGS. 5 and 6, the cable support member 50 includes an upwardly extending portion 52 that forms a divider to form a pair of side-by-side cable support surface areas 53. Cable support member 50 has a length "A" (FIG. 5) that may be varied to provide a relatively large cable support member 50 extending substantially along the entire length of the beams 4 between a pair of H-frames 26. Cable support member 50 is made from a relatively thin polymer material and includes edge portions 54 having semi-circular or elliptical cross-sectional shapes to provide reinforcement. The openings 55 formed by the C-shaped ends have a width corresponding to the width of beams 4 to permit beam 4 to be received within opening 55.

Figure 8:
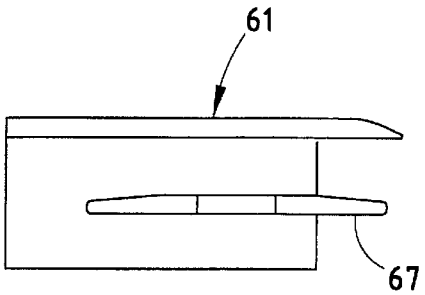
FIG. 8 is a side elevational view of the grommet of FIG. 7.
Figure 7:
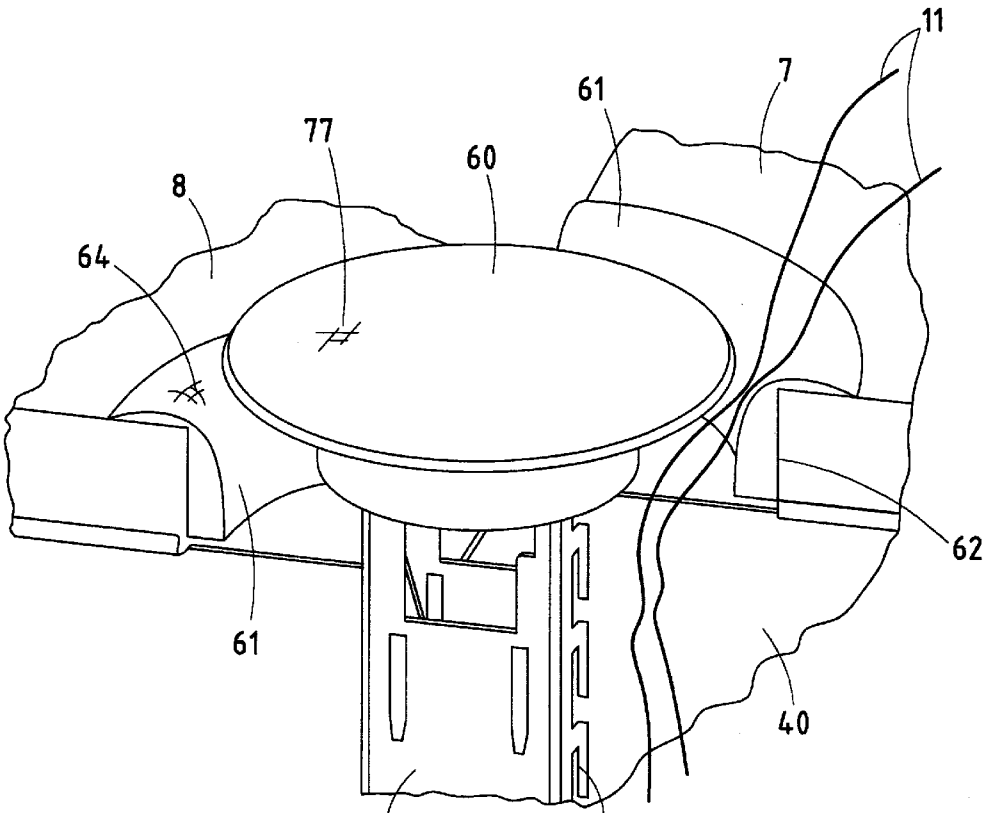
FIG. 7 is a fragmentary, perspective view of a post cap and grommet arrangement that permits vertical routing of utilities lines in the trader desk of FIG. 1.
Figure 9:
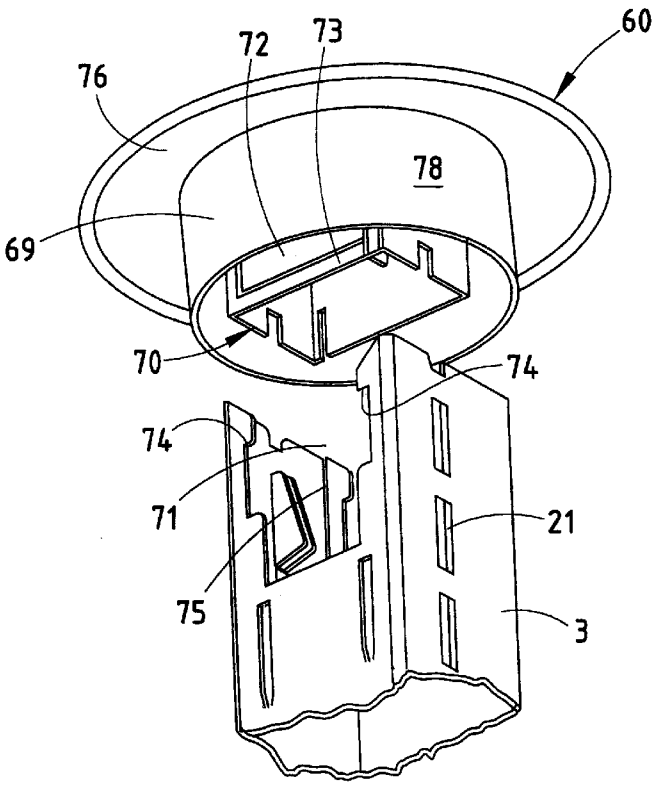
FIG. 9 is a partially fragmentary, perspective view showing the top cap of FIG. 7.

With further reference to FIG. 7, a cap 60 may be mounted to the upper end of a post 3 to provide a finished appearance. The corner portion of worksurfaces 7 and 8 include concave curved edge portions 62 (FIG. 2) that are spaced-apart from the posts 3 to form a gap 63 to permit vertical routing of utility lines 11 from the storage area 6 to areas above the worksurfaces 7 and 8. Curved edge portion 62 is preferably either a quarter circular edge portion 64, or a one-half circular portion 65. Each of the edge portions 64 and 65 include a groove 66 that receives a lip 67 (FIG. 8) of a grommet 61 to retain and locate the grommet on the worksurface. Each of the grommets 61 have a smoothly curved surface 68 to facilitate routing of the utility lines 11 without damage to the lines 11. In cross-section, surface 68 forms a smooth, gently curved convex shaped perimeter. With reference to FIG. 9, cap 60 includes a tube-like portion 69 formed by wall 78. An inner connector 70 is received in the opened upper end 71 of the posts 3 when assembled. Connector 70 includes a flexible sidewall 72 having a tapered lip 73 at the end thereof. Upon insertion of connector 70 into open end 71 of post 3, the lip 73 snaps into place, and engages the edge 74 of opening 75 in post 3 to retain the cap 60 on the post 3. Cap 60 has a circular upper surface 77, and a horizontally extending flange 76 extending outwardly from the tubular portion 69. The cap 60 and grommets 61 together provide a finished appearance while permitting routing of utility lines 11 from the storage area 6 to the upper surfaces of the worksurfaces 7 and 8. Advantageously, the cap and grommet arrangement can accommodate adjacent worksurfaces located at different heights, while still permitting vertical routing of utility lines 11.

With reference to FIG. 1, in a preferred mode, central worksurface 8 includes an extrusion 80 attached to the inner edge 81 of worksurface 8. Extrusion 80 is a standard extrusion available from 80/20 Inc. of Columbia City, Ind. Extrusion 80 includes a plurality of "T-slots" 82 which receive a wide variety of standard accessories available from 80/20 Inc. For example, with reference to FIG. 2, a computer display screen 83 is mounted on a pivoting support arm 84. The pivoting support arm 84 is connected to the extrusion 80 utilizing a standard mounting plate available from 80/20 Inc. Support arm 84 permits pivoting and/or horizontal translation of the computer display screen 83. A variety of other types of accessories (not shown) may also be secured to the extrusion 80 to provide support for various tasks. For example, one or more vertical privacy screens may be secured to extrusion 80. Also, a standard Steelcase/details Workflo® Rail may also be mounted to extrusion 80.

The desk 1 of the present invention provides a knock-down construction that can be easily assembled at the installation site. Furthermore, in the event the configuration of the trader desk needs to be changed, the frame 2 can be disassembled to the extent required and rearranged to provide additional or fewer worksurfaces 7 and 8, as required for a particular application. The worksurfaces 7 and 8 may be independently adjusted for height by disengagement of cantilever brackets 40 with openings 21 in posts 3. In a preferred configuration, the central worksurface 8 is located at a lower height than the adjacent outer worksurface 7, such that computer display screens and the like located on the central worksurface 8 do not obstruct a user's vision across the desk 1. Because the storage area 6 is open, and the H-frames 26 have a large U-shaped upper open portion 24, utility lines 11 can be routed along the length trader desk 1. Significantly, desk 1 may be assembled to virtually any required length, and may include two or more H-frames 26 interconnected with beams 4. In this configuration, the open H-frames 26 and storage area 6 permit routing of the utility lines 11 through each of the adjacent frame sections. Also, standard file cabinets, carts, and the like (not shown) having casters can be positioned below the outer worksurfaces 7, or positioned within the storage area 6, thereby providing support for a variety of work environments. Because the beams 4 are positioned upwardly from the floor surface, various types of electronic equipment, such as "tower" type personal computers can be easily moved into storage area 6 on a cart 23, or placed directly on the floor surface. Significantly, the open storage area 6 has sufficient height to permit positioning of relatively large electronic units, such as tower type PCs, below worksurfaces 8. The desk 1 of the present invention may be utilized to support a wide variety of tasks in a broad range of environments wherein user support for various information technologies is needed, such that the desk 1 is not limited in use to trading room applications.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A knock-down trader desk comprising:

a frame having at least two upright frame members and at least two horizontal beams, said beams releasably interconnecting said upright frame members to form a freestanding knock-down rigid frame, said frame including a vertically extending connecting arrangement;

a plurality of vertically oriented panels detachably connected to said rigid frame to define a storage area within said rigid frame;

at least three worksurfaces including a pair of outer worksurfaces defining two opposed user accessible elongate edges, said edges positioned outwardly from said frame, and at least one central worksurface positioned above said storage area and between said outer worksurfaces, said three worksurfaces engagable with said vertically extending connecting arrangement of said frame at a plurality of heights whereby said three worksurfaces are selectively positionable at selected ones of a plurality of heights; and at least one access opening for passing utility lines from said storage area to an upper surface of said central worksurface.

2. The knock-down trader desk set forth in claim 1, wherein:

each upright member includes a pair of spaced-apart posts and a horizontally-extending cross member rigidly interconnecting said pair of posts to form a frame member having an H-shape.

3. The knock-down trader desk set forth in claim 2, wherein:

each post defines an upper end, and each said beam defines opposite ends connected to said upper ends.

4. The knock-down trader desk set forth in claim 2, wherein:

said central worksurface is connected to at least one post in a cantilevered manner.

5. The knock-down trader desk set forth in claim 4, wherein:

said central worksurface comprises a first central worksurface, and including:

a second central worksurface connected to a selected post in a cantilevered manner.

6. The knock-down trader desk set forth in claim 5, wherein:

each post defines an inner face having a vertical row of openings defining said vertically extending connecting arrangement, and including:

at least one pair of cantilever brackets engaging openings in a selected one of said posts to support a pair of side-by-side worksurfaces positioned at different heights.

7. The knock-down trader desk set forth in claim 2, wherein:

at least one of said worksurfaces has a concave cut-out portion defining a curved edge spaced-apart from a selected one of said posts to define an opening therebetween for routing of utility lines.

8. The knock-down trader desk set forth in claim 7, including:

a cap secured to an upper end of said selected one of said posts, said cap having a curved perimeter portion that is spaced above said curved edge of said worksurface.

9. The knock-down trader desk set forth in claim 1, including:

a support foot connected to a lower end of a selected upright frame member and extending outwardly away from said storage area to provide increased stability.

10. The knock-down trader desk set forth in claim 1, wherein:

said frame has an open side having an unobstructed lower portion to permit storage units to be freely moved into said storage area supported on a floor surface.

11. A furniture unit having a knock-down construction, said furniture unit comprising:

a frame having at least two upright members and at least two horizontally spaced-apart horizontal members, said horizontal members rigidly yet releasably interconnecting said upright members to form a rigid frame;

at least one generally horizontal worksurface attached to said frame, and wherein said furniture unit has at least one user accessible elongate edge; and at least one cable support member having opposed C-shaped ends forming hangers, each of said hangers engaged with a selected horizontal frame member whereby said cable support member is suspended in proximity to said worksurface.

12. The furniture unit set forth in claim 11, wherein:

said cable support member includes an upwardly-extending divider forming a cable support area on each side of said divider.

13. The furniture unit set forth in claim 12, wherein:

said C-shaped ends extend upwardly relative to said cable support areas such that said cable support areas are positioned below an uppermost surface of said horizontal members.

14. The furniture unit set forth in claim 13, wherein:

said C-shaped ends engage said horizontal members and removably suspend said cable support member.

15. The furniture unit set forth in claim 11, wherein:

said at least one cable support member comprises a plurality of cable support members having opposed C-shaped ends forming hangers.

16. The furniture unit set forth in claim 15, wherein:

said cable support members are arranged side-by-side and extend along substantially the entire length of said frame.

17. The furniture unit set forth in claim 11, wherein:

said upright members and said horizontal members are rigidly interconnected by threadless quick-connectors to provide a knock-down frame construction.

18. A trader desk comprising:

a frame having spaced-apart vertically extending frame portions defining a central space;

a pair of center worksurfaces extending horizontally into said central space, said center worksurface adjustably cantilevered to selected ones of said vertically extending frame portions in a manner permitting attachment of said center worksurfaces at selected ones of a plurality of heights within said upwardly-opening central space of said frame for supporting a display screen on each said center worksurfaces at a selected height, said worksurfaces defining a longitudinally extending gap therebetween; and a pair of horizontally spaced-apart outer worksurfaces attached to said frame and positioned adjacent said central space with at least a selected one of said center worksurfaces between and below said outer worksurfaces.

19. The trader desk set forth in claim 18, wherein:

said center worksurface comprises a first center worksurface; and including:

a second center worksurface adjustably cantilevered to a selected one of said vertically extending frame members and extending horizontally into said central space.

20. The trader desk set forth in claim 19, wherein:

said frame includes at least four vertical posts having vertical rows of openings on inner and outer faces; and including:

at least one cantilever bracket engaging said openings and adjustably supporting said first center worksurface.

21. The trader desk set forth in claim 20, including:

a plurality of support feet secured to said outer faces of said posts and extending outwardly therefrom to provide stability for said trader desk.

22. The trader desk set forth in claim 21, wherein:

said frame includes first and second pairs of posts, and a horizontal cross member rigidly interconnecting each said pair of posts to form a pair of spaced-apart frame members having an H-shape, said frame further including at least two beams extending between said H-shaped frame members and rigidly interconnecting said H-shaped frame members.

23. A freestanding furniture unit, comprising:

a rigid frame including at least one vertically extending frame member having an upper portion, said frame having a lower portion adapted to abuttingly support said frame freestanding on a floor surface; and first and second horizontal worksurfaces, each supported by said vertically extending frame member, said first and second horizontal worksurfaces being independently height adjustable and defining concave curved edge portions adjacent said upper portion of said frame member, wherein said concave curved edge portions are horizontally spaced-apart from said upper portion to define a gap therebetween for routing of utility lines.

24. The freestanding furniture unit set forth in claim 23, wherein:

said frame member defines an upper end above said upper portion, said upper end having a horizontally extending flange.

25. The freestanding furniture unit set forth in claim 24, including:

a cap secured to said frame member and having an upper surface with a circular perimeter, the outer portion of which is formed by said horizontally extending flange.

26. The freestanding furniture unit set forth in claim 25, wherein:

said first and second horizontal worksurfaces each include a grommet secured thereto and forming said curved edge portion; and said curved edge portion having an arcuate plan shape.

27. The freestanding furniture unit set forth in claim 26, wherein:

said grommets have a quarter circular plan shape and a cross-sectional shape having a smooth curved convex portion.

* * * * *